US005702303A

United States Patent [19]

Takemoto et al.

[11] Patent Number: 5,702,303

[45] Date of Patent: Dec. 30, 1997

[54] GAME MACHINE HAVING A PLAYING DISPLAY SCREEN

[75] Inventors: Takatoshi Takemoto; Masayuki Tsurumi, both of Tokyo, Japan

[73] Assignee: Kabushiki Kaisha Ace Denken, Tokyo, Japan

[21] Appl. No.: 295,910

[22] PCT Filed: Mar. 10, 1993

[86] PCT No.: PCT/JP93/00296

§ 371 Date: Sep. 12, 1994

§ 102(e) Date: Sep. 12, 1994

[87] PCT Pub. No.: WO93/17766

PCT Pub. Date: Sep. 16, 1993

[30] Foreign Application Priority Data

Mar. 10, 1992 [JP] Japan ..... 4-051873
Mar. 10, 1992 [JP] Japan ..... 4-051874

[51] Int. Cl.[6] ..... A63F 5/04; A63F 7/02

[52] U.S. Cl. ..... 463/27

[58] Field of Search ..... 273/138 A, 143 R, 273/121 B; 463/16, 17, 18, 19, 20, 21, 25, 26, 27, 31

[56] References Cited

U.S. PATENT DOCUMENTS

| | | | |
|---|---|---|---|
| 4,216,461 | 8/1980 | Werth et al. | 273/143 R |
| 5,127,651 | 7/1992 | Okada | 273/143 R |
| 5,209,476 | 5/1993 | Eiba | 273/138 A |
| 5,344,144 | 9/1994 | Canon | 273/138 A |

FOREIGN PATENT DOCUMENTS

| | | |
|---|---|---|
| 0 443 420 | 8/1991 | European Pat. Off. . |
| 0 443 738 | 8/1991 | European Pat. Off. . |
| 56-152691 | 11/1981 | Japan . |
| 58-157189 | 10/1983 | Japan . |
| 61-226076 | 10/1986 | Japan . |
| 62-41680 | 2/1987 | Japan . |
| 62-177771 | 11/1987 | Japan . |
| 63-13193 | 1/1988 | Japan . |
| 63-22966 | 2/1988 | Japan . |
| 1-13390 | 3/1989 | Japan . |
| 2-164384 | 6/1990 | Japan . |
| 3-234274 | 10/1991 | Japan . |
| 3-242686 | 10/1991 | Japan . |
| 4-40191 | 2/1992 | Japan . |
| 2 124 418 | 2/1984 | United Kingdom . |

*Primary Examiner*—Jennifer Bahr
*Assistant Examiner*—Eric F. Winakur
*Attorney, Agent, or Firm*—Lowe, Price, LeBlanc & Becker

[57] ABSTRACT

A game machine, having a game display screen, for paying out game play media for a winning game if a given condition is satisfied after a game is started after game play media are input. The game machine comprises an input counter for cumulatively counting and outputting the number of input game play media, a payout counter for cumulatively counting and outputting the number of paid-out game play media, a processing unit for finding a difference between outputs of the input counter and the payout counter and outputting the difference as a profit/loss count of game play media, and a memory for sequentially storing the profit/loss count output from the processing unit every specific period together with the actual time. A processing section displays information, representing change of the profit/loss count with time, stored in the memory, in a part of the game display screen.

22 Claims, 9 Drawing Sheets

FIG. 7

| | (a) | (b) | (c) | (d) | (e) | (f) | (g) | (h) | (i) |
|---|---|---|---|---|---|---|---|---|---|
| 1 | 14:16 | 7820 | 5020 | 7820 | 2350 | 35 | 0 | 0.0 | 2:53 |
| 2 | 14:55 | 11180 | 4580 | 3110 | 2360 | 38 | 0 | 0.0 | 2:49 |
| 3 | 15:15 | 12820 | 3020 | 1400 | 2440 | 42 | 0 | 0.0 | 2:58 |
| 4 | 15:19 | 13160 | 660 | 80 | 2140 | 0 | 0 | 0.0 | 2:54 |
| 5 | 15:55 | 16540 | 240 | 3120 | 2430 | 44 | 0 | 0.0 | 2:59 |
| 6 | 15:59 | 16810 | -2180 | 10 | 2140 | 0 | 0 | 0.0 | 3:03 |
| 7 | 16:16 | 18370 | -3630 | 1290 | 2350 | 46 | 0 | 0.0 | 2:58 |
| 8 | 17:18 | 23810 | -2590 | 5190 | 2440 | 34 | 0 | 0.0 | 2:58 |
| 9 | 17:22 | 24110 | -4990 | 40 | 2430 | 0 | 0 | 0.0 | 2:59 |
| 10 | 20:04 | 34300 | -1300 | 9920 | 2460 | 38 | 0 | 0.0 | 2:58 |
| 11 | 20:15 | 34740 | -3560 | 200 | 2270 | 0 | 0 | 0.0 | 2:53 |
| 12 | 20:19 | 34990 | -5810 | 20 | 2460 | 0 | 0 | 0.0 | 2:53 |
| 13 | 21:58 | 41100 | -4500 | 5870 | 2250 | 35 | 0 | 0.0 | 3:02 |
| | 23:04 | 41740 | -6560 | 390 | | | | | |

(a) Occurence time
(b) Input coin count
(c) Profit/loss count
(d) Input coin count during jackpot
(e) Paid-out coin count during jackpot
(f) G value
(g) Start count
(h) Start/min
(i) Jackpot

GAME MACHINE HAVING A PLAYING DISPLAY SCREEN

TECHNICAL FIELD

This invention relates to a game machine for displaying a game play image on a display screen, to enable a player to play a game, and in particular to a game machine having a function of displaying information indicating the operation state of the game machine.

TECHNICAL BACKGROUND

With some game machines in game houses, a player inputs game play media such as coins, medals, chips, or balls to the game machine in order to start playing a game, and if they satisfy a given condition while playing the game, a predetermined number of game play media are paid out to the player for the winning game, from the game machine. Game machines of this type include slot machines and pinball machines, for example.

In the game house, as part of management it is necessary to know how the game machines operate. For example, at some game machines, it may be extremely easy for players to win games and at some it may be extremely difficult for players to win games. If the number of the former game machines increases, the game house suffers a great loss. In contrast, if the number of the latter game machines increases, the players lose interest in playing, and as a result, the game house will lose customers. Therefore, in the game house, it becomes necessary to adjust the ease with which players can win games for each game machine, change locations of the game machines, or replace the game machines with new ones. For these purposes, management data is required.

Management data of this kind includes profit/loss count data representing change with time of the difference between the number of input game play media and the number of paid-out game play media (profit/loss count), for example. Ease of players winning games is adjusted by changing a setting of the payout rate, a control target value of the ratio of the number of paid-out game play media to the number of input game play media for each game machine, based on the data.

The management data also includes sales data indicating the sales of each game machine. Whether or not specific game machines should remain installed and whether or not the locations of specific game machines are to be changed are determined by management based on the sales data.

Management data of this kind is automatically provided and stored by a computer or the like which controls the game machines in the game house. However, the data on the game machines is usually displayed in batch from only on a display or the like of a management computer which manages the entire game house. To adjust the ease with which players win games, etc., personnel in the game house must select the corresponding data from among the data displayed in batch from. Thus, it is not easy for personnel to look up necessary management data such as profit/loss count data. Particularly, nowadays control software varies from one model to another and various adjustment methods and various ranges of necessary data are mixed, thus it is evenmore difficult to access the necessary data. Depending on the situation, personnel in the game house rely on their own experience or perception to adjust the ease with which players win games or change the setting of the payout rate.

However, personnel's experience and perception vary from one person to another, so management of the game house varies depending on personal character. If adjustment is made without using a management computer, although it is installed, introduction of the computer does not make sense and is unreasonable.

To solve this problem, it is possible to display respective management data on each game machine. The slot machine described in Japanese Patent Laid-Open No. Hei 3-234274 is available as a game machine having a management data display function. The game machine is adapted to display a graph representing the profit/loss count on a dedicated display installed on the front.

However, since a dedicated display needs to be provided for displaying a profit/loss count graph, the slot machine increases in cost by as much as the cost for installing the dedicated display.

On the other hand, some players grasp the profit/loss trend of game play media, namely, the trend of ease of winning games, at the game machine while playing games, and determine whether or not the game machine is profitable from a players point of view. Making such a judgement is certainly one of the pleasures of playing games. However, it is difficult for the beginner to make such a judgement. For this reason, it is desirable to offer display of the above-mentioned profit/loss count data for players.

However, if the profit/loss count for the game machine becomes too explicit, part of the enjoyment associated with the games, such as the accidental nature and the anticipatory thrill of playing games, will be lost. That is, data of this kind informs the players which game machines are profitable and which are not, so that the players can select game machines simply by reading data. Moreover, the data referenced by a player who selects a game machine is based on the game results of others made so far and is not their own data. Thus, the players will be deprived of the enjoyment of a game based on determination by trial and error.

Data of this kind enables the players to select profitable game machines without experimentation. Therefore, whereas the players formerly played a few games at several game machines before making a decesion, they now need only to see data before making their judgement so the players will center around only specific game machines and sales at other game machines will decrease. This is undesirable from a management point of view.

Further, data necessary only to management, such as sales data, should not be disclosed to the players. It is desired to suppress display of such data to the customers. Moreover, formerly, it was not possible to specify whether or not data should be displayed according to the data contents.

DISCLOSURE OF THE INVENTION

It is a first object of the invention to provide a game machine which can display data indicating change of a profit/loss count with time in a simple structure, without installing a dedicated display.

It is a second object of the invention to provide a game machine which can display data indicating change of a profit/loss count with time upon receipt of an external request.

It is a third object of the invention to provide a game machine which has a function of allowing only personnel in the game house to see detailed operation data.

To accomplish the first object of the invention, according to a first form of the invention, there is provided a game machine having a display having a game display screen and control means for paying out game play media for a winning game if a given condition is satisfied after a game is started after game play media are input, wherein the improvement comprises:

an input counter for cumulatively counting and outputting the number of input game play media;

a payout counter for cumulatively counting and outputting the number of paid-out game play media;

operation means for finding a difference between outputs of the input counter and the payout counter and outputting the difference as a profit/loss count of game play media; and storage means for sequentially storing the profit/loss count output from the operation means every specific timing together with the time, the control means having a processing section for determining the game start/end and upon determination of the game start, the processing section for displaying information representing change of the profit/loss count after the start point in time of the current game stored in the storage means in a part of the game display screen and upon determination of the game end, for clearing the display.

To accomplish the second object of the invention, according to a second form of the invention, the game machine according to the first form further includes display selection means for inputting a display command of information representing change of the profit/loss count and an external clear command for the display, to the control means, wherein the processing section, upon receipt of the display command, displays information representing change of the profit/loss count with time stored in the storage means in a part of the game display screen and upon receipt of the clear command, clears the display of the information representing the change of the profit/loss count.

To accomplish the third object of the invention, according to the third form of the invention, in the game machine according to the second form, the display selection means accepts an input of a specific identification signal, and the processing section, when the identification signal is input, displays detailed management data stored in the storage means in a part of the display screen.

According to a fourth form of the invention, the game machine according to the first form further includes identification signal input means for inputting an identification signal, wherein the processing section, when the identification signal is input, displays detailed management data stored in the storage means in a part of the display screen.

According to a fifth form of the invention, there is provided a game machine having a display having a game display screen and control means for paying out game play media for a winning game play if a given condition is satisfied after a game is started after game play media are input, wherein the improvement comprises:

storage means for storing management data containing a plurality of types of data indicating the operation state of the game machine; and identification signal input means for inputting an identification signal, the control means, upon input of the identification signal, for displaying at least a part of the management data stored in the storage means in a part of the display screen.

The detailed management data is, for example, information representing change of a cumulative profit/loss count with time for all games stored in the storage means at that point in time.

According to the game machine of the invention, the numbers of input and paid-out game play media during game playing are cumulatively counted by the input counter and the payout counter. The operation means calculates the profit/loss count based on the counts of the counters. The operation result is stored in the storage means every predetermined time, together with the time. The data of the profit/loss counts with the time stored in the storage means is displayed by the control means in a part of the game liquid crystal screen as information representing change of the profit/loss count with time. A trend graph is possible as the display form.

According to a sixth form of the invention, there is provided a game system comprising a plurality of game machines for paying out game play media for a winning game if a given condition is satisfied after a game is started after game play media are input and a management computer for managing the game machines, each of the game machines comprises:

a display having a game display screen;

a jackpot output section for detecting a jackpot condition during game execution and controlling payout of game play media for the winning game play and outputting information indicating the jackpot condition;

an input counter for cumulatively counting and outputting the number of input game play media; and a payout counter for cumulatively counting and outputting the number of paid-out game play media, the management computer for reading information indicating the jackpot condition of the jackpot output section and the counts of the input and payout counters from each of the game machines for preparing management data and sending a part of the management data to the corresponding game machine for displaying it in a part of the display screen of the display of the game machine.

According to a seventh form of the invention, there is provided a game machine having a display having a game display screen and control means for paying out game play media for a winning game if a given condition is satisfied after a game is started after game play media are input, wherein the improvement comprises:

an input counter for cumulatively counting and outputting the number of input game play media; and a player detector for detecting a player existing at a game play position and outputting a detection signal, the control means further including:

a player determination section for outputting a player signal if the detection signal of the player detector is output for a predetermined time or longer;

a quantitative input determination section for outputting a quantitative input signal if the number of input coins counted by the input counter becomes a predetermined number or more; and a processing section for determining the game start and end, the processing section for judging the start of a game when both the player signal from the player determination section and the quantitative input signal from the quantitative input determination section, and judging the game end when the input of the player signal stops.

BRIEF DESCRIPTION OF THE DRAWINGS

In the accompanying drawings:

FIG. 7 is a table showing one example of the display format of management data used in the invention;

BEST MODE FOR CARRYING OUT THE INVENTION

Referring now to the accompanying drawings, there are shown preferred embodiments of the invention.

Figure 1:
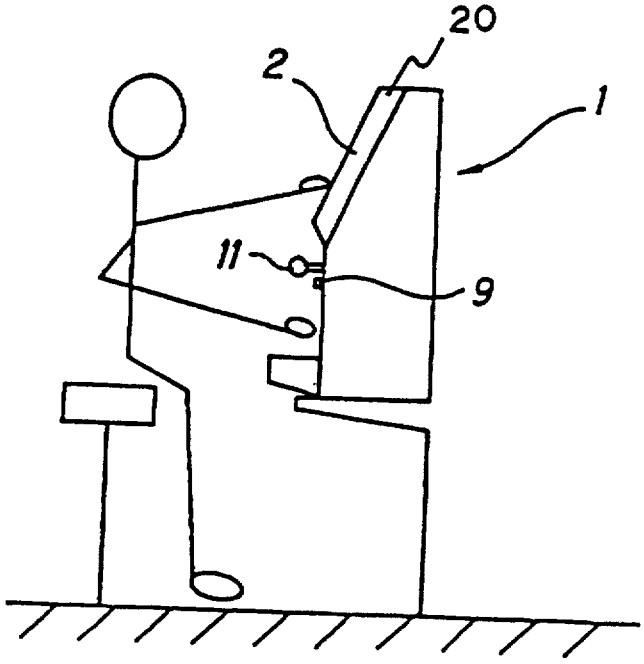
FIG. 1 is a side view of a game machine according to a first embodiment of the invention.
Figure 2:
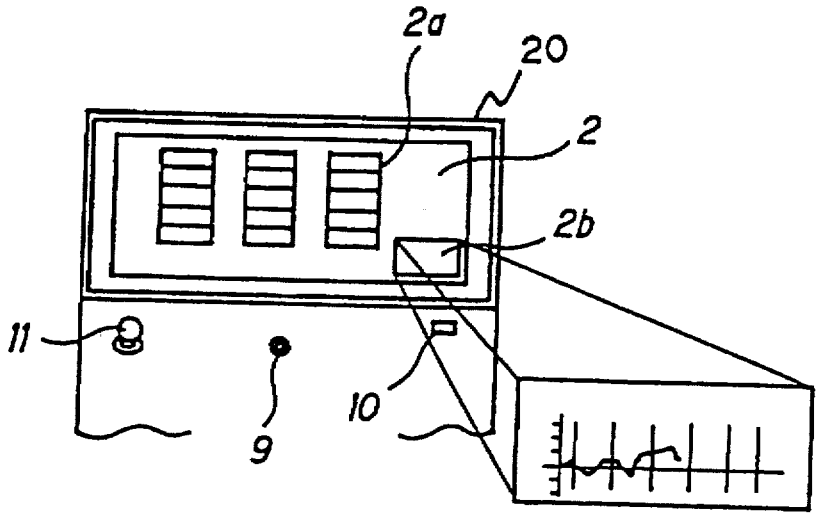
FIG. 2 is a front view of the game machine of the first embodiment of the invention.

As shown in FIGS. 1 and 2, a game machine 1 according to a first embodiment of the invention is a slot machine using a liquid crystal display system which is provided with a liquid crystal display 20 having a display screen 2 on the front, wherein game graphic symbols 2*a* corresponding to a plurality of rotating drums are displayed on the screen 2. With the slot machine, a player starts a game after inputting coins (game play media) to a coin slot (not shown), and if the player satisfies a given condition, such as alignment of the symbols 2*a* in a specific direction, coins are paid out to the player, for the winning game, from the slot machine. In addition to the game display 20, a player detector 9, a display selector 10, and a start lever 11 are installed on the front of the slot machine. Further, a coin return la for receiving paid-out coins is installed in the lower part of the front.

Figure 3:
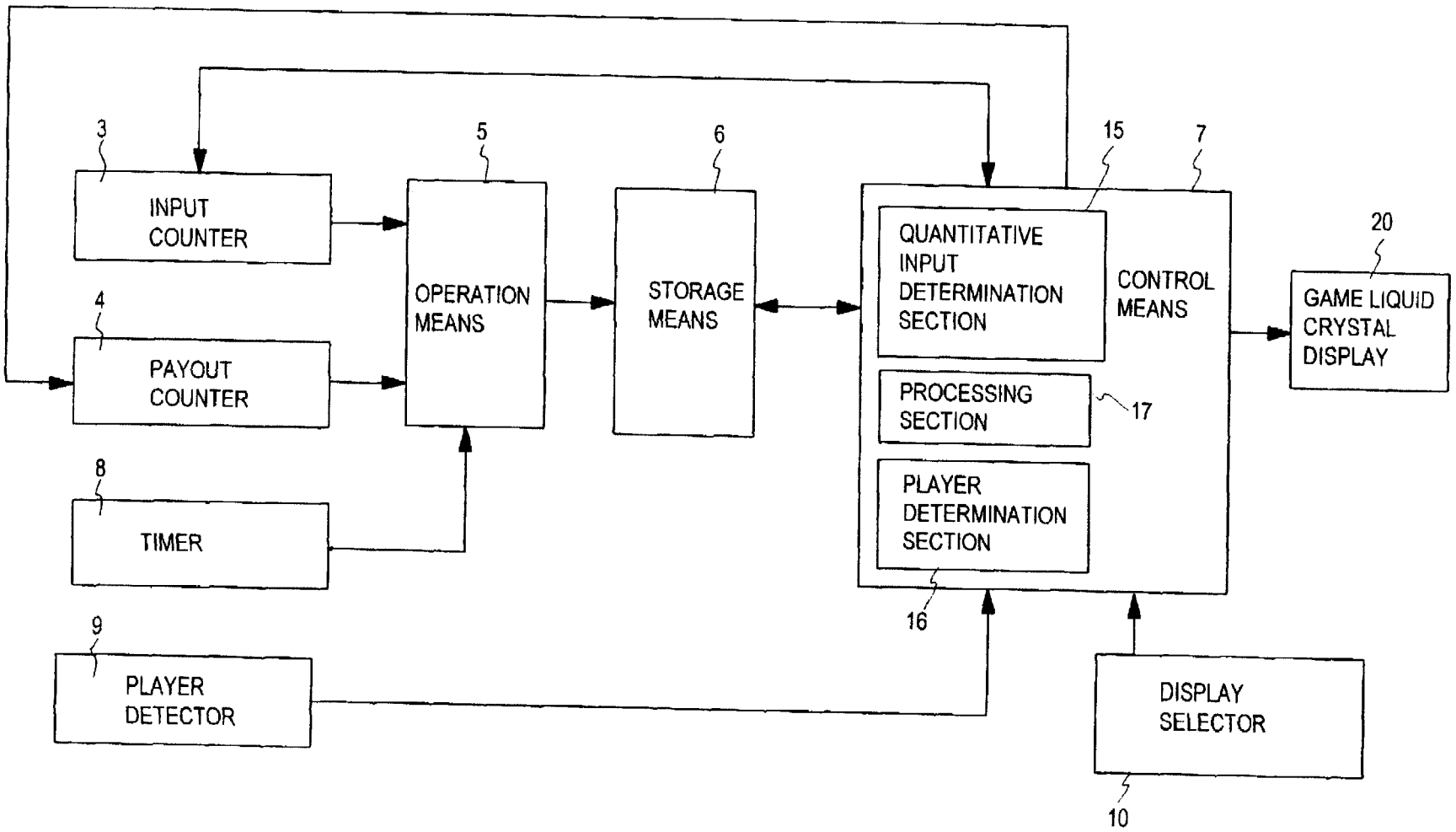
FIG. 3 is a block diagram showing the configuration of the game machine of the first embodiment of the invention.
Figure 4:
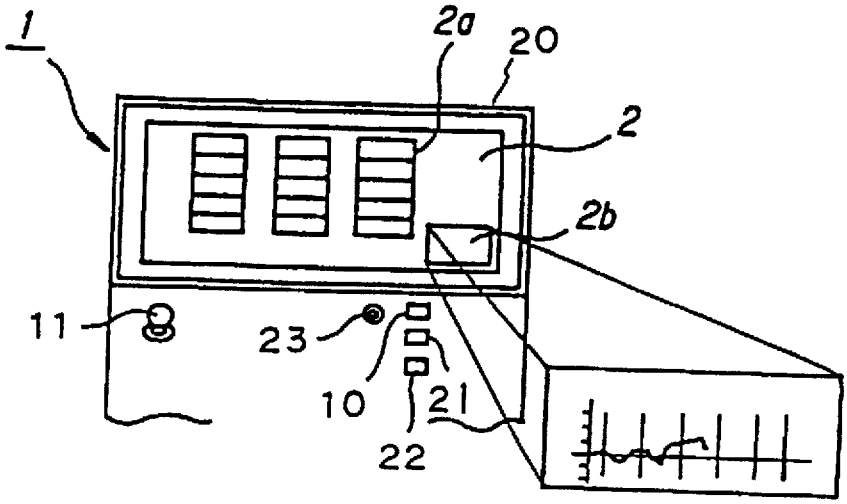
FIG. 4 is a front view of a game machine according to a second embodiment of the invention.

As shown in FIG. 3, the slot machine 1 contains an input counter 3 for cumulatively counting the number of input coins and outputting the count, a payout counter 4 for cumulatively counting the number of paid-out coins and outputting the count, operation means 5 for calculating the difference between outputs of the input counter 3 and the payout counter 4 to find out the coin profit/loss count and outputting it, storage means 6 for sequentially storing the profit/loss count output from the operation means 5 every predetermined time together with the time, control means 7 for controlling the display screen of the game liquid crystal display 20 to display the data stored in the storage means 6, and a timer 8 for counting the date and time.

The liquid crystal display 20 has a liquid crystal display panel (not shown) constituting the display screen 2, a drive circuit (not shown) for driving the liquid crystal display panel, and a display memory (not shown) for storing display data.

A well-known counter being located at the coin slot for sensing passage of coins for counting the number of input coins may be used as the input counter 3. A well-known counter being located at a coin payout section (not shown) for sensing passage of coins for counting the number of paid-out coins may be used as the payout counter 4. The operation means 6 can consist, for example, of an electronic operation circuit for performing subtraction.

The storage means 6 receives an output of the timer 8 and sequentially stores the management data every predetermined time, together with the date and time. For example, the storage means 6 consists of a semiconductor memory and a controller, such as a CPU, for controlling the memory. It can also be made of a memory operating under the control of the control means 7. In the embodiment, data is recorded every given time, but the invention is not thing limited. For example, data can also be recorded each time a given event occurs. The events may be occurrence of a winning game, detection of illegal action, etc.

The data stored in the storage means 6 is up loaded into a host computer system, not shown in the embodiment, at a given period, for example, every day. At that time, the data stored so far is initialized, and the counts of the input counter 3 and the payout counter 4 are also initialized.

The control means 7 provides a quantitative input determination section 15 for outputting a quantitative input signal when the input count received from the input counter 3 reaches a predetermined count or more, a player determination section 16 for outputting a player signal when a detection signal from the player detector is output for a predetermined time or longer, and a processing section 17 for controlling the display screen 2 of the game liquid crystal display 20 upon receipt of the signals of the quantitative input determination section 15 and the player determination section 16 or a command from the display selector 10.

For example, the control means 7 can be made of a computer system having a central processing unit (CPU), a read-only memory (ROM), a random access memory (RAM), etc. The operation means 5, the storage means 6, and the control means 7 may be constituted as a whole by a common computer system.

When judging the start of a game, the processing section 17 draws information representing the profit/loss count as a chart such as a graph based on profit/loss count data in relation to the time stored in the storage means 6, provided that a display command is input from the display selector 10. The information representing the profit/loss count is displayed as a subwindow 2*b* in one corner of the game display screen 2. In the embodiment, the information representing the profit/loss count is displayed as a trend graph indicating change of the profit/loss count with time. In the embodiment, numeric values are not shown and only a change trend is shown. The trend display range is only data on the current player in the embodiment. That is, data indicating the profit/loss count occurring after the end of the preceding game constitute current display range.

In addition to graphs such as a broken line graph and a bar graph, inclination of a balance or the like may be shown graphically, for example, as display in the subwindow 2*b*. This also applies to other embodiment discussed later.

As in a second embodiment described below, numeric values of a trend graph may be displayed, provided that a special identification signal is input.

When judging the game end, the processing section 17 clears display of the graph and registers the end time of the game in the storage means 6 for determining the start point of the trend graph display range of the profit/loss counts for the next game. Recording of the input count data in the input counter 3, the payout count data in the payout counter 4, and the profit/loss count data in the storage means 6 is continued. When both a player signal from the player determination section 16 and a quantitative input signal from the quantitative input determination section 15 are input, the processing section 17 judges the start of a game, and when the input of the player signal stops, it judges the end of the game.

For example, the player detector 9 emits an ultrasonic wave, a microwave, or the like toward the position at which a player sits and detects a reflected wave for detecting the player.

The display selector 10, which is made of a key switch, is provided for the player to specify whether or not a window representing profit/loss count data is to be displayed. The display selector 10 can also be used to input the identification signal mentioned above, in which case the identification signal may be formed relating on and off states of the switch to special patterns.

The control means 7 does not display the window on the game display screen 2 unless the processing section 17 judges the game start as described above. However, if a game is started and the window is displayed, the control means 7 enables erasion of the window when the player handles the display selector 10.

Next, the operation of the embodiment will be described.

When a player inputs coins and operates the start lever 10, the game graphic symbols 2*a* simulate rotation for starting a game. That is, graphic symbols 2*a* on three drums displayed on the display screen 2 of the liquid crystal display 20 are rewritten in order for display so that they appear to be rotating. When a given time has elapsed, the processing section 17 stops rotation of the drums, namely, stops rewriting of the graphic symbols. Then, the processing section 17 determines a combination of the three game graphic symbols 2*a* when they stop, and if the combination matches a predetermined pattern, it pays out coins to the player for the winning game play through a payout slot (not shown).

At this time, the number of input coins and that of paid-out coins are sequentially counted by the counters 3 and 4. The count data is sent to the operation means 5, which then finds the profit/loss count sequentially from the data. The profit/loss count is stored in the storage means 6 together with the date and time.

When a player sits down on a chair in front of the game machine 1, the player detector 9 detects it and a player signal is output from the player determination section 16.

If the operation mode of the display selector 10 is set to the display mode, when the number of input coins reaches a given quantity and a quantitative input signal is output from the quantitative input determination section 15, the processing section 17 reads data of profit/loss counts occurring after the preceding game end time stored in the storage means 4, and draws the data as a trend graph (slump graph) for display as a subwindow 2*b* in one corner of the game display screen 2, as shown in FIG. 2.

Thus, the player can know the game play media profit/loss trend with respect to their own game plays, at a glance. Therefore, the player need not count the number of input coins, the number of paid-out coins, etc., themselves in order to know what they are. For example, if the player does not want other players, etc., to see the game play media profit/loss progress in their own game plays, they can operate the display selector 10 to stop (clear) the display at any time.

When the player ends playing games and leaves his or her seat in front of the slot machine 1, the player detector 9 detects it and stops outputting the player signal. Then, the processing section 17 detects it and clears the display and registers the game end time in the storage means 6.

To check a slot machine for operation status, personnel in the game house perform a switch operation corresponding to a specific identification signal from the display selector 10. Then, the control means 7 receives it and presents data indicating the change state of the cumulative profit/loss count up to the current point in time for the slot machine as a trend graph.

Thus, the data on the preceding game plays is not displayed for another player who plays a game at the slot machine 1, and only data on a current sequence of game plays is displayed. On the other hand, personnel in the game machine can see the data stored so far by inputting a specific identification signal.

Personnel in the game house can also see data other than the profit/loss counts by inputting a specific command, for example, they can see the play rate (G value) of players at the machine as described below and the cumulative values of the numbers of input and paid-out coins, etc.

Thus, according to the slot machine, a graph representing the profit/loss counts can be automatically displayed for convenience of players. Moreover, a dedicated display for graph display is not required, so the effect of suppressing an increase in costs of the game machine can be produced.

At the slot machine, the profit/loss count data on past games played by others is not displayed. Once displayed profit/loss count data automatically disappears under the control of the control means 7 when the current player leaves his or her seat. Thus, trouble caused by displaying graph data over a wide range does not occur.

In the embodiment, no data is displayed in the subwindow 2*b* until the coin input quantity reaches a predetermined quantity, but the number of input coins, for example, may be displayed before a graph is displayed.

The location of the subwindow 2*b* is not limited to one corner of the display screen 2; the subwindow 2*b* can be displayed in any appropriate location not hindering display of the game contents.

Next, a second embodiment of the invention will be discussed.

Like the game machine of the first embodiment, a game machine 1 according to the second embodiment of the invention is a slot machine using a liquid crystal display system (liquid crystal game machine) which is provided with a liquid crystal display 20 having a game liquid crystal screen 2 on the front, wherein game graphic symbols 2*a* corresponding to rotating drums are displayed on the screen 2.

A player starts a game after inputting coins (game play media) to a coin slot (not shown), and if the player satisfies a given condition, coins are paid out to the player for the winning game from the slot machine. In addition to the game liquid crystal screen 2, an identification signal input device 23, a display selector 10, a display change device 21, a screen change device 22, and a start lever 11 are installed on the front of the slot machine.

Figure 5:
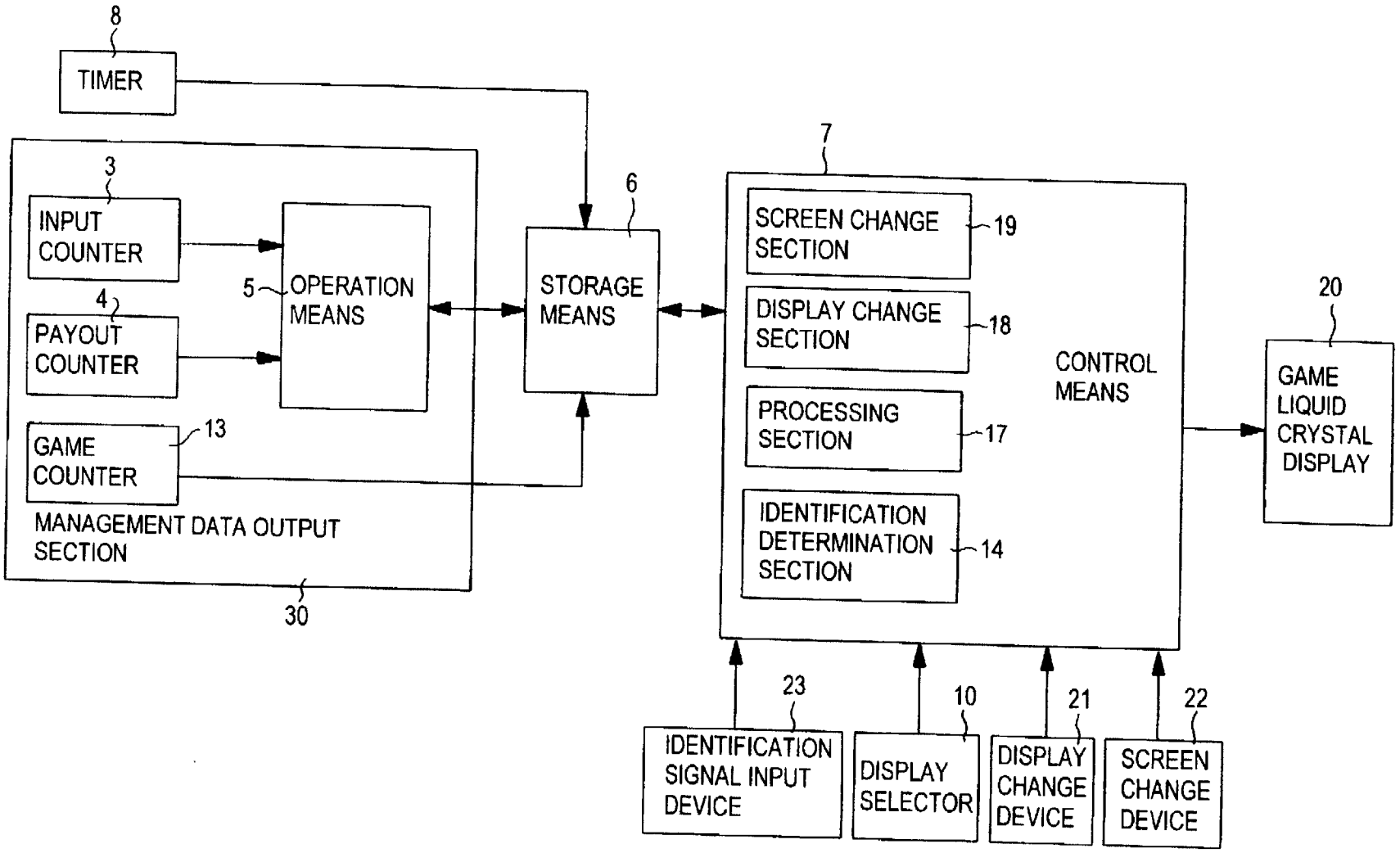
FIG. 5 is a block diagram showing the configuration of the game machine of the second embodiment of the invention.

As shown in FIG. 5, the slot machine 1 contains a management data output section 30 for collecting and outputting management data (consisting of management basic data and management process data described below), storage means 6 for storing the management data output by the output section 30, control means 7 for controlling the game liquid crystal screen 2 to display the management data stored in the storage means 6, and a timer 8 for counting the date and time.

The management data output section 30 consists of an input counter 3 for cumulatively counting the number of input coins, a payout counter 4 for counting the number of paid-out coins, a game counter 13 for counting the number of times a game has been played and outputting the count, and operation means 5 for calculating the coin profit/loss count from the difference between the number of input coins and the number of paid-out coins output from the input counter 3 and the payout counter 4. That is, in the embodiment, the number of input coins, the number of paid-out coins, and the game count are management basic data, and the profit/loss count is management process data.

A well-known counter, being located at the coin slot for sensing passage of coins for counting the number of input coins, may be used as the input counter 3. A well-known counter, being located at a coin payout section (not shown) for sensing passage of coins for counting the number of paid-out coins, may be used as the payout counter 4. The game counter 13 can be made of a counter for counting the number of times the start lever 11 has been handled. Further, the operation means 5 can consist, for example, of an electronic operation circuit for performing subtraction.

The storage means 6 receives an output of the timer 8 and sequentially stores the management data every predetermined time together with the date and time. For example, the storage means 6 can be made up of a semiconductor memory and a controller, such as a CPU, for controlling the memory. It may be made of a memory operating under the control of the control means 7.

The control means 7 provides an identification determination section 14 for determining whether or not an identification signal input from the identification signal input device 23 matches a preset one, a processing section 17 for reading management data from the storage means 6 in response to a command of the display selector 10 and displaying it on the game liquid crystal screen 2 in a predetermined mode or form, provided that the identification determination section 14 determines that the input identification signal is the same as the preset one, a display change section 18 responsive to a command of the display change device 21 for changing the display form of the management data by the processing section 17, and a screen change section 19 responsive to a command of the screen change device 22 for changing the display mode of the management data on the game liquid crystal screen 2.

The display form changed by the display change section 18, is the method of displaying management data, such as daily totalization display, daily graph display, or hourly change quantity display (trend graph). For example, whenever the display change device 21 is operated, the display form is changed sequentially by the display change section 18 and the processing section 17, in association with each other. In the embodiment, when no identification signal is input from the identification signal input device 23, only hourly change quantity display is made.

The display mode changed by the screen change section 19 includes full screen display and subwindow display. The full screen display is a mode in which the game graphic symbols 2*a* are cleared and management data such as profit/loss count data is displayed on the full game liquid crystal screen 2. The subwindow display is a mode in which the game graphic symbols 2*a* remain displayed and the subwindow 2*b* is displayed in a part, such as one corner, of the game liquid crystal screen 2 for displaying the management data.

For example, whenever the screen change device 22 is handled, the display mode is changed sequentially by the screen change section 19 and the processing section 17, in association with each other.

When a preset identification signal is not input from the identification signal input device 23, the control means 7 operates so as to display the management data in a predetermined range, namely, only a trend graph representing a change of the profit/loss count in the current game, as described in the first embodiment, on the game liquid crystal screen 2. However, when an identification signal is input, the control means 7 is not limited to the current game and totalizes management data and displays the result. Even when the identification signal is input, the control means 7 clears the display if the display selector 10 is operated.

The control means 7 can be made of, for example, a computer system consisting of a CPU, a ROM, a RAM, etc., like the control means shown in FIG. 3. The operation means 5, the storage means 6, and the control means 7 may be collectively made of a common computer system.

For example, the identification signal input device 23 may be constructed having for example, an element for receiving an infrared ray and a circuit for detecting an identification signal from its light reception signal. The display selector 10, the display change device 21, and the screen change device 22 are each made of a key switch for accepting an external command from the external.

The type of management data read from the storage means 6 for display (in this case, the profit/loss count or game count) needs to be specified for the processing section 17 in the control means 7. The function for specifying the data type can be provided by additional input means, or the display selector 10 or the like may be adapted to serve as the input means.

Next, the operation of the embodiment will be described.

When a player inputs coins and operates the start lever 11, the game graphic symbols 2*a* simulate rotation for starting a game, as in the first embodiment. Then, the processing section 17 determines a combination of the three game graphic symbols 2*a* when they stop, and if the combination corresponds to a win, it pays out coins to the player for the winning game through a payout slot (not shown).

At this time, the number of input coins, the number of paid-out coins, and the game count (management data) are sequentially counted by the counters 3, 4, and 13. The management data is processed directly or via the operation means 5 to the profit/loss count and the data is stored in the storage means 6 together with the date and time. The preceding game end time is also registered in the storage means 6.

For data indicating change of the profit/loss count, the processing section 17 prepares and displays a trend graph for the data after the start time of the current game, as in the first embodiment. It is displayed without performing any additional operation.

Desired data of the management data stored in the storage means 6 can be displayed on the game liquid crystal screen 2 in the mode and form as described above by operating the display selector 10, etc. However, unless a preset identification signal (in this embodiment, an infrared signal) is input from the identification signal input device 23, operation of the display selector 10, etc., is ignored by the identification determination section 14 and the processing section 17 described above, and they do not function.

Thus, if an infrared signal transmitter for outputting the identification signal is given to personnel in the game house managing the slot machines, they can instantly know the management data for each slot machine by inputting the identification signal at any time. On the other hand, players cannot see the management data freely and can see it only under the control of personnel in the game house.

To clearly distinguish the infrared signal from noise, a signal represented by a proper pulse code can be superposed on the infrared ray for transmission. In this case, the identification signal input device 23 may have a circuit for separating the pulse signal from the infrared ray.

Therefore, according to the slot machine of the embodiment, the data indicating change of the profit/loss count required for players can be provided for the players. Personnel in the game house can also easily know the data required for precise adjustment of the slot machines and determining problems on game house management, such as arrangement of the machines. In addition, the game house can prevent players from being informed of the data carelessly. Moreover, a dedicated display for management data display is not required, thus the effect of suppressing an increase in costs of the game machine can be produced.

Next, a third embodiment of the invention will be discussed with reference to the accompanying drawings.

Figure 6:
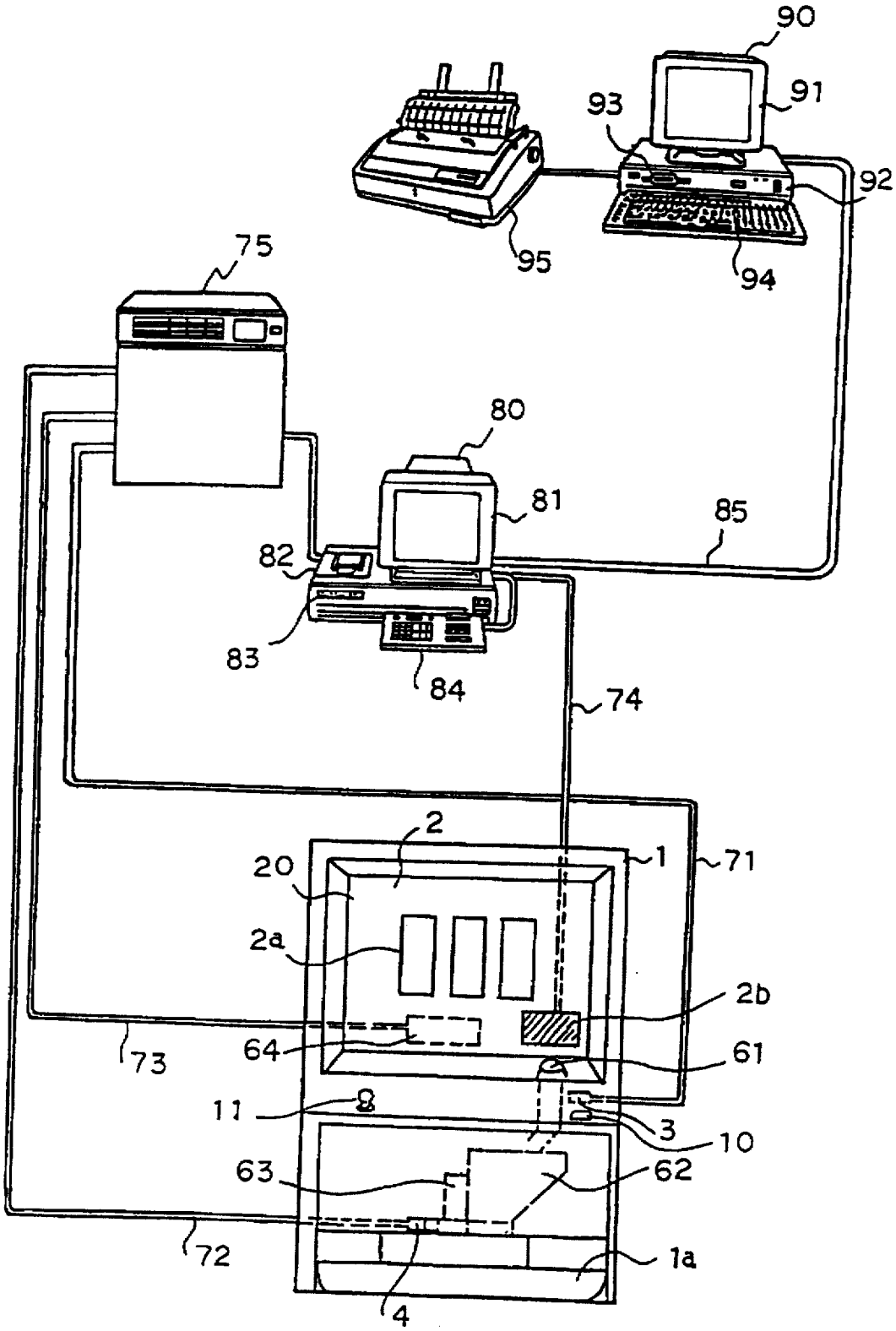
FIG. 6 is a block diagram showing the configuration of a game house system comprising game machines according to a third embodiment of the invention.

FIG. 6 shows an outline of the configuration of the third embodiment of the invention. The third embodiment comprises a plurality of slot machines 1 (only one slot machine is shown in FIG. 6), a data collector 75 being connected to these slot machines 1 for collecting and storing data such as the number of input coins, the number of paid-out coins, and a jackpot from each slot machine 1, a game house management computer 80 which receives various pieces of data from the data collector 75 and performs processing required for management of the game machines in the game house, and an administration computer 90 which receives data from the game house management computer 80 and prepares management data required for managing the game machines in the game house.

Like the slot machines of the first and second embodiments, the slot machine 1 comprises a liquid crystal display 20 having a display screen 2 on which graphic symbols 2*a* on rotating drums are displayed, a coin slot 61 located just under the display screen 2, a hopper 62 for storing coins input through the coin slot and coins supplied from a supply device (not shown), a payout controller 63 for controlling when coins stored in the hopper 62 are paid out to a coin return 1*a* for a winning game, an input counter 3 for counting the number of coins input through the coin slot, a payout counter 4 for counting the number of coins paid out to the coin return 1*a* from the hopper 62, and a jackpot output section 64 for detecting a jackpot. It further includes a display selector 10.

The jackpot output section 64 monitors a signal specifying displayed graphic symbols at the slot machine, and if the graphic symbols make a specific set, such as (7, 7, 7), the output section 64 determines that it is a jackpot, and outputs a signal. The jackpot is a condition in which when the graphic symbols make a specific set in a specific condition at the slot machine, a greater number of coins are paid out than the number of coins paid out when the graphic symbols make a different set. The jackpot condition continues for a given time at the slot machine. The continuation time is set at random and varies from one time to another. If the graphic symbols make a set during the continuation time, a greater number of coins are paid out than the normal number of paid-out coins.

The jackpot output section 64 sends the drum rotation start count, namely, the rewrite start count of the game graphic symbols 2*a* at the slot machine to the data collector 75. The drum rotation start can be detected, for example, by reading a start indication signal generated when a player operates the start lever 11. Of course, it may be detected by reading a signal for specifying rewriting of graphic symbols.

The liquid crystal display 20 has a subwindow 2*b* displayed in the lower right corner of the display screen. Data displayed in the subwindow 2*b* is sent via a data information signal line 74 from the game house management computer 80.

The count at the input counter 3 is sent via an input count signal line 71 to the data collector 75. The payout counter 4 is sent via a payout count signal line to the data collector 75. Further, a signal of the jackpot output section 64 is sent via a jackpot signal line 73 to the data collector 75.

The game house management computer 80 comprises a CRT display 81, a main unit 82 for executing information processing, an auxiliary storage 83 for writing/reading into/from magnetic storage media installed in the main unit, and a keyboard 84 for entering commands, etc. The game house management computer 80 arranges the data collected in the data collector 75 for each slot machine and processes it to numeric values and graphs required for management for display on the display 81. The data is transferred via a signal line 85 to the administration computer 90 at a given period, for example, every day.

In addition to the above-mentioned data, the count result of the proceeds of a coin lending machine, the number of coins paid out for winning games, and signals such as a broken line of a proceeds counter are input to the data collector 75.

The administration computer 90 comprises a CRT display 91, a main unit 92 for executing information processing, an auxiliary storage 93 for writing/reading into/from magnetic storage media installed in the main unit, a keyboard 94 for entering commands, etc., and a printer 95 for printing out data. The administration computer 90 processes the data required for administration of the game house, such as sales data and the operation rate of each slot machine.

The slot machine 1 contains a computer system for processing execution of games, not shown in the embodiment, like the computer system shown in the first and second embodiments.

In the third embodiment, when a player inputs coins to the coin slot 61, the input counter 3 counts the number of coins and sends a signal indicating the input coin count via the input count signal line 71 to the data collector 75.

When the player presses the start lever 11, the slot machine 1 rewrites game graphic symbols 2*a* displayed on the display screen 2 in an order as if the drums rotated, and stops them at random. In the stopped condition, the slot machine 1 determines whether or not the display pattern of the symbols matches a predetermined pattern for determining a win, a jackpot, or a miss. If the display pattern corresponds to a win or jackpot, the slot machine 1 instructs the payout controller 63 to pay out as many coins as the number of coins conforming to the number of input coins and the predetermined payout rate. Then, coins are paid out to a coin return 1*a*. At this time, the payout counter 4 counts the number of paid-out coins and sends the count data to the data collector 75.

If a jackpot occurs, as many coins as the number of coins conforming to the jackpot are paid out, and the jackpot output section 64 detects the jackpot condition and informs the data collector 75 of the jackpot condition. Further, the jackpot output section 64 sends a signal indicating the drum rotation start to the data collector 75.

The data collector 75 reads these pieces of information from each slot machine and stores them sequentially for each slot machine together with the date and time.

The game house management computer 80 reads the data stored in the data collector 75 and arranges and processes the data as management data for display on the display 81 and also stores the data in the internal storage. For example, the following data items are prepared:

(a) cumulative value of input coin counts (b) profit/loss count, difference between input and paid-out coin counts (c) input coin count during jackpot (d) paid-out coin count during jackpot (e) G value indicating play rate of player (f) drum rotation start count (start count)

(g) minutely start count (h) jackpot continuation time

The G value indicating the play rate of a player is found from the following expression using the values in a to d:

$$\{(a-b-d)/a-c\}\times 100(\%)=G\ value$$

where (a-b) is the paid-out coin count.

The G value ranges from 0 to 99.999. For example, if the G value is high (large), it means that the player holds a large number of coins (game play media).

This means that the play time of the player is long.

These data items are displayed on the display 81 in the format, for example, as shown in FIG. 7. In the format in FIG. 7, the data entries for one slot machine (in the example, for slot machine number 113) are displayed. In FIG. 7, the occurrence time denotes the time of day at which a jackpot occurred. That is, in FIG. 7, the data is displayed whenever a jackpot occurs. Of course, it may be displayed at a given period. More finely, it may be displayed whenever a win occurs.

A profit/loss count which is minus indicates that the input coin count is greater than the paid-out coin count, indicating that the player is ahead in terms of winning games. In FIG. 7, all 0s are entered under Start count and Start/rain because the computer is instructed to suppress display of these data entries. In fact, jackpots occurred and therefore the start count is displayed here, for example, as 30 (times).

The display area on the display 81 is limited. Unless otherwise specified, the most recent data is displayed preferentially. Therefore, to see the past data, for example, a scroll operation may be performed with the keyboard. In the embodiment, daily data is stored in the game house management computer 80 and is updated every day. Therefore, the data on past days will be seen on the administration computer 90.

Figure 8:
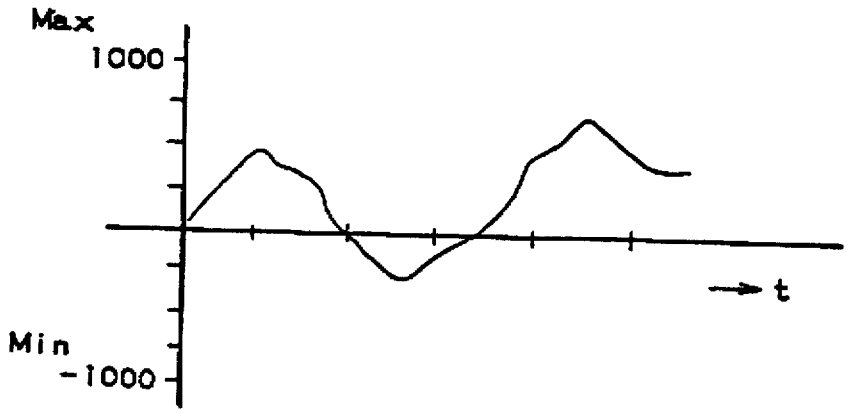
FIG. 8 is a graph showing an example of a displayed trend graph in third and fourth embodiments.
Figure 9:
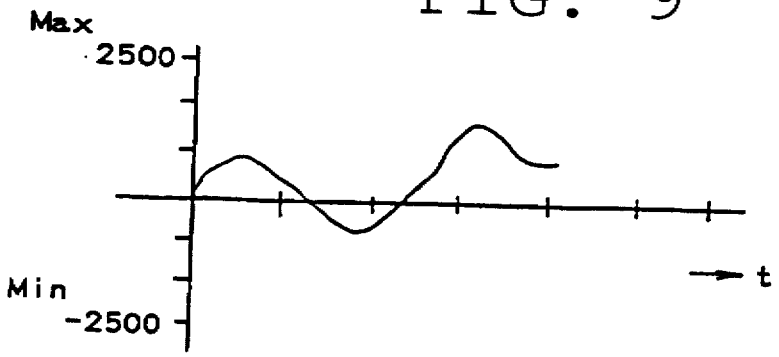
FIG. 9 is a graph showing an example of a displayed trend graph in third and fourth embodiments.

The game house management computer 80 prepares a trend graph for displaying the profit/loss counts based on the data shown in FIG. 7 for each slot machine, and sends it to the corresponding slot machine for display in the subwindow **2*b*. FIGS. 8 and 9 show examples of the trend graph. FIG. 8 is an example in which the maximum and minimum values of the profit/loss count are small and FIG. 9 is an example in which the maximum and minimum values of the profit/loss count are large. The range is changed to display the graph in the subwindow 2*b*** of finite size. In the examples, data on the slot machine starting at the opening of the game house on that day is displayed.

Next, a fourth embodiment of the invention will be discussed.

Figure 10:
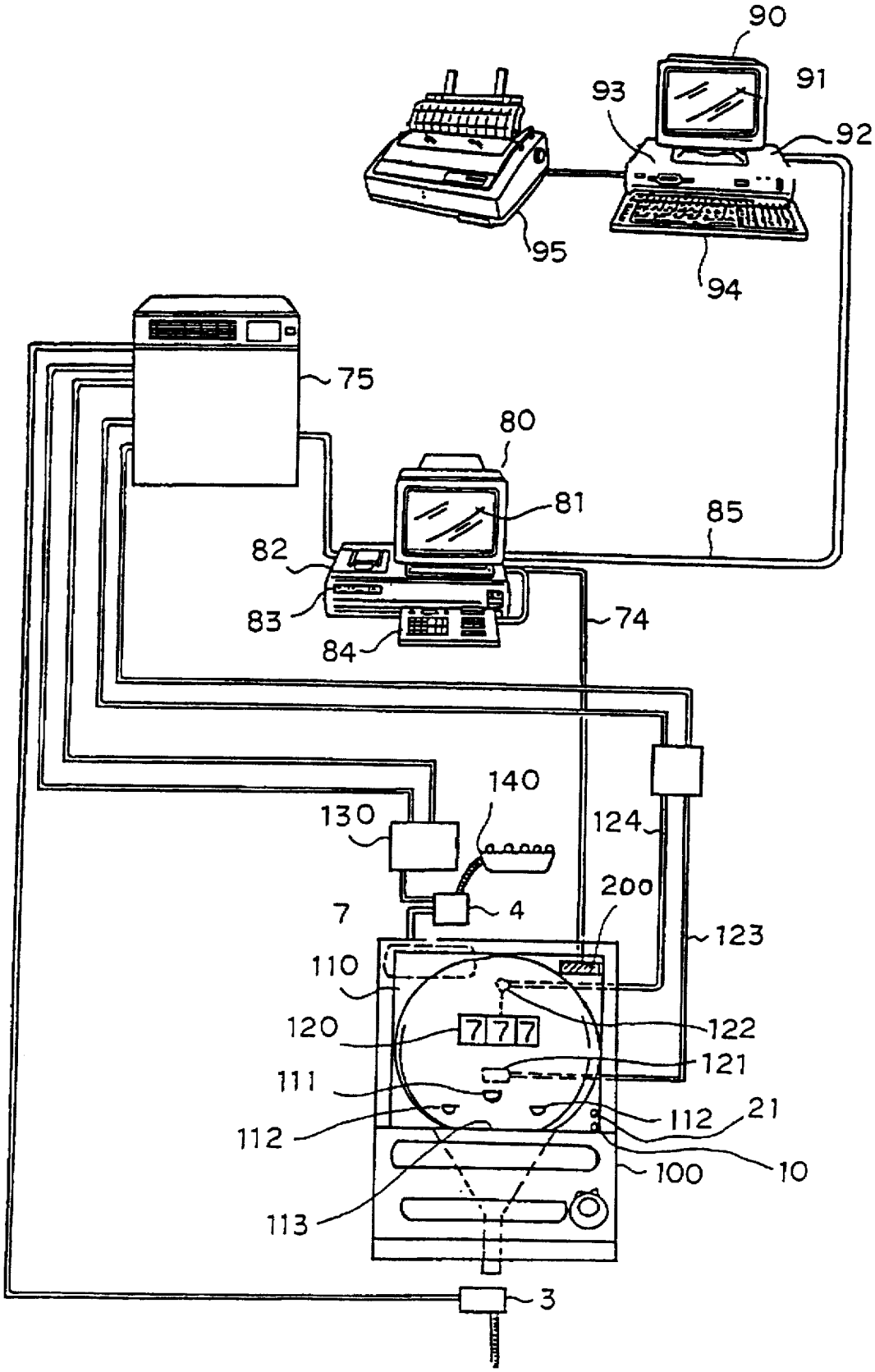
FIG. 10 is a block diagram showing the configuration of a game house system comprising game machines according to a fourth embodiment of the invention.

The embodiment shown in FIG. 10 is an example of applying the invention to a pinball machine. In the embodiment, metal balls called "pinballs" are used as game play media.

The embodiment comprises a plurality of pinball machines 100, a data collector 75 for collecting and storing various pieces of data from the pinball machines 100, a game house management computer 80 which arranges and processes the data collected in the data collector 75 and stores and displays the data as management data, and an administration computer 90 which prepares administration material based on the management data. Components identical with those previously described in the first to third embodiments are denoted by the same reference numerals in the fourth embodiment and will not be discussed again.

The pinball machine 100 has a game region 110 formed on the front. The game region 110 is provided with a jackpot device 120 with graphic symbols displayed as with a slot machine and functioning like a slot machine, pinball entering holes 111 and 112, and a hole 113 where pinballs not entering the hole 111 or 112 are finally collected. When a pinball enters one of the holes 111 and 112, a predetermined number of pinballs are paid out to a pinball return **100*a* for the winning game play. The holes 112 are located at a plurality of positions in the game region 110. On the other hand, the hole 111 is located at a specific position (may be located at a plurality of specific positions) in the game region 110. Disposed above the hole 111 is a sensor 121 for detecting a pinball entering the hole 111. When the sensor 121 detects a pinball entering the hole 111, the pinball machine 100 rewrites the symbols displayed in the jackpot device 120** as if slot machine drums had rotated, and stops it when a given time has elapsed.

The game region 110 is formed with a sensor 122 for sensing that the symbols displayed in the jackpot device 120 make a predetermined pattern.

The pinball machine 100 is provided with a display section 200 corresponding to the subwindow **2*b* of the game machine in the first to third embodiments described above. The display contents in the display section 200 are similar to those described above. A display selector 10 and a display change device 21 are provided in the lower right corner of the game region 110**.

Further, disposed above the pinball machine 100 are a replenishment device 140 for replenishing the pinball machine 100 with pinballs, a payout counter 4 for counting the number of pinballs supplied from the replenishment device 140 for detecting the paid-out pinball count, and a counting control section 130 for controlling payout and counting.

On the other hand, an input counter 3 for counting the number of input pinballs is installed in the portion where pinballs entering the holes 111, 112, and 113 are gathered and discharged under the pinball machine 100.

In the embodiment, as in the first to third embodiments, the input pinball count, paid-out pinball count, rewrite start of symbols in the jackpot device, jackpot condition, and jackpot condition continuation are detected. These are sent to the data collector. The subsequent data processing is similar to that in the first to third embodiments. Therefore, as in the embodiments, the management data can be seen on the display 81 of the game house management computer 80, and in the display section 200, players can see a simple trend graph and personnel in the game house can see more detailed data by performing necessary operation.

Although slot machines are taken as examples of game machines in the first and second embodiments, the invention can also apply to pinball machines using a liquid crystal display system, for example.

In the embodiments, liquid crystal displays are taken as examples of displays for the game machines, but the invention is not limited to these. For example, CRT displays, plasma displays, etc., can also be used.

In addition to the management data described in the embodiments, various types of management data may be possible.

Also, the configuration of the input device is not limited to the embodiments. For example, all commands can be input only by inputting infrared signals.

We claim:

1. A game machine having a display having a game display screen and control means for paying out game play media for a winning game if a given condition is satisfied after a game is started after game play media are input, wherein the improvement comprises:

an input counter for cumulatively counting and outputting a value corresponding to the number of game play media input into the machine;

a payout counter for cumulatively counting and outputting a value corresponding to the number of game play media paid out by said control means;

computing means for finding a difference between the value output by said input counter and the value output by said payout counter and outputting the difference as a profit/loss count of game play media;

storage means for sequentially storing the profit/loss count output from said computing means together with the time at which said profit/loss count is output by said computing means;

detecting means for detecting a game start and a game end, said control means having a processing section for, upon determination of the game start, displaying information representing change of the profit/loss count since the start of the current game, stored in said storage means, in a part of said game display screen, and upon determination of the game end, for clearing the display.

2. The game machine as claimed in claim 1 wherein said detecting means includes a player detector for detecting whether a player is present at a game play position and outputting a detection signal, and wherein said detecting means determines the game start or the game end in response to a change in the detection signal from said player detector.

3. The game machine as claimed in claim 2 wherein said detecting means further includes:

a player determination section for outputting a player signal if the detection signal of said player detector is output for a predetermined time or longer; and a quantitative input determination section for outputting a quantitative signal if the number of game play media input into the machine and counted by said input counter becomes a predetermined number or more, and wherein said detecting means judges the game start to occur when both the player signal has been output from said player determination section and the quantitative signal has been output from said quantitative input determination section, and judges the game end to occur when the input of the player signal stops.

4. The game machine as claimed in claim 3 further including display selection means for inputting a display command instructing said control means to display information representing change of the profit/loss count on said display screen and a clear command instructing said control means to clear the display screen from an external source, wherein said processing section, upon receipt of the display command, causes the display screen to display information representing change of the profit/loss count with time stored in said storage means in a part of said game display screen and upon receipt of the clear command, causes the display screen to clear the display of the information representing the change of the profit/loss count.

5. The game machine as claimed in claim 4 wherein said storage means further stores detailed management data representing an operation state of said game machine in addition to the profit/loss count data, wherein said display selection means accepts an input of a specific identification signal, and wherein said processing section, when the identification signal is input, causes the display screen to display the detailed management data stored in said storage means in a part of said display screen.

6. The game machine as claimed in claim 5 wherein said detailed management data is information representing change of a cumulative profit/loss count for all games stored in said storage means at a point in time.

7. The game machine as claimed in claim 3 wherein said processing section causes the display screen to display information representing change of the profit/loss count as a subwindow in a part of said game display screen.

8. The game machine as claimed in claim 7 further including a screen change device for specifying whether the information representing change of the profit/loss count is to be displayed on the display screen or in the subwindow, wherein said control means is responsive to specification from said screen change device for causing the display screen to display the information representing change of the profit/loss count either on the display screen or in the subwindow.

9. The game machine as claimed in claim 3 wherein the profit/loss count, and the time at which the profit/loss count is output, are stored at each occurrence of a jackpot.

10. The game machine as claimed in claim 3 wherein the profit/loss count, and the time at which the profit/loss is output, are stored at every specific period of a predetermined length of time.

11. The game machine as claimed in claim 2, further including display selection means for inputting a display command instructing said control means to display information representing change of the profit/loss count on said display screen and a clear command instructing said control means to clear the display from an external source, wherein said processing section, upon reception of the display command, causes the display screen to display information, representing change of the profit/loss count with time stored in said storage means, in a part of said game display screen and upon receipt of the clear command, causes the display screen to clear the display of the information representing the change of the profit/loss count.

12. The game machine as claimed in claim 2, further including identification signal input means for inputting an identification signal, wherein said storage means further stores detailed management data representing an operation state of said game machine in addition to the profit/loss count data, and wherein said processing section, when the identification signal is input, causes the display screen to display the detailed management data stored in said storage means in a part of said display screen.

13. The game machine as claimed in claim 12, wherein said detailed management data is information representing change of a cumulative profit/loss count for all games stored in said storage means at a point in time.

14. The game machine as claimed in claim 2, wherein said storage means further stores detailed management data representing an operation state of said game machine in addition to the profit/loss count data, wherein said display selection means accepts an input of a specific identification signal, and wherein said processing section, when the identification signal is input, causes the display screen to display the detailed management data stored in said storage means in a part of said display screen.

15. The game machine as claimed in claim 1 further including identification signal input means for inputting an identification signal, wherein said storage means further stores detailed management data representing an operation state of said game machine in addition to the profit/loss count data, and wherein said processing section, when the identification signal is input, causes the display screen to display the detailed management data stored in said storage means in a part of said display screen.

16. The game machine as claimed in claim 1 further including display selection means for inputting a display command instructing said control means to display information representing change of the profit/loss count on said display screen and a clear command instructing said control means to clear the display from an external source, wherein said processing section, upon reception of the display command, causes the display screen to display information, representing change of the profit/loss count with time stored in said storage means, in a part of said game display screen and upon receipt of the clear command, causes the display screen to clear the display of the information representing the change of the profit/loss count.

17. The game machine as claimed in claim 16 wherein said storage means further stores detailed management data representing an operation state of said game machine in addition to the profit/loss count data, wherein said display selection means accepts an input of a specific identification signal, and wherein said processing section, when the identification signal is input, causes the display screen to display the detailed management data stored in said storage means in a part of said display screen.

18. The game machine as claimed in claim 17 wherein said detailed management data is information representing change of a cumulative profit/loss count for all games stored in said storage means at a point in time.

19. A game machine having a display having a game display screen and control means for paying out game play media for a winning game if a given condition is satisfied after a game is started after game play media are input, wherein the improvement comprises:

an input counter for cumulatively counting and outputting a value corresponding to the number of game play media input into the game machine; and a player detector for detecting whether a player is present at a game play position and outputting a detection signal, said control means further including:

a player determination section for outputting a player signal if the detection signal of said player detector is output for a predetermined time or longer;

a quantitative input determination section for outputting a quantitative signal if the number of game play media input into the machine and counted by said input counter becomes a predetermined number or more; and a processing section for determining game start and end, said processing section judging the game start to occur when both the player signal has been output from said player determination section and the quantitative signal has been output from said quantitative input determination section, and judging the game end to occur when the input of the player signal stops.

20. A game system comprising a plurality of game machines for paying out game play media for a winning game if a given condition is satisfied after a game is started after game play media are input and a management computer for managing said plurality of game machines, each of said game machines comprising:

a display having a game display screen;

a jackpot output section for detecting a jackpot condition during game execution and controlling payout of game play media for the winning game play and outputting information indicating the jackpot condition;

an input counter for cumulatively counting and outputting a value corresponding to the number of game play media input into the game machine; and a payout counter for cumulatively counting and outputting a value corresponding to the number of game play media paid out by said jackpot output section;

said management computer reading said information indicating the jackpot condition output by said jackpot output section and the values output by each of said input and payout counters from each of said game machines, preparing management data and sending a part of the management data to the corresponding game machine for displaying said part of the management data in a part of said display screen of said display of said game machine.

21. The game system as claimed in claim 20 wherein said part of said management data is a profit/loss count, being a difference between the number of game play media input into the game machine and the number of game play media paid out by said control means.

22. The game system as claimed in claim 21 further including a data collector, located between said game machines and said management computer, for reading and storing said information indicating the jackpot condition output by said jackpot output section and the values output by said input and payout counters from each of said game machines and sending the data to said management computer.

* * * * *